US009636805B2

(12) United States Patent
Wang

(10) Patent No.: US 9,636,805 B2
(45) Date of Patent: May 2, 2017

(54) RETRACTABLE PLIERS

(71) Applicants: HANGZHOU GREAT STAR TOOLS CO., LTD, Hangzhou, Zhejiang Province (CN); HANGZHOU GREAT STAR INDUSTRIAL CO., LTD, Hangzhou, Zhejiang Province (CN)

(72) Inventor: Min Wang, Hangzhou (CN)

( * ) Notice: Subject to any disclaimer, the term of this patent is extended or adjusted under 35 U.S.C. 154(b) by 191 days.

(21) Appl. No.: 14/369,678

(22) PCT Filed: Mar. 15, 2013

(86) PCT No.: PCT/CN2013/072733
§ 371 (c)(1),
(2) Date: Jun. 27, 2014

(87) PCT Pub. No.: WO2013/135202
PCT Pub. Date: Sep. 19, 2013

(65) Prior Publication Data

US 2015/0020651 A1 Jan. 22, 2015

(30) Foreign Application Priority Data

Mar. 16, 2012 (CN) ..... 2012 1 0070314

(51) Int. Cl.
*B25B 7/18* (2006.01)
*B25F 1/00* (2006.01)
(Continued)

(52) U.S. Cl.
CPC ..... *B25B 7/18* (2013.01); *B25F 1/003* (2013.01); *B25F 1/04* (2013.01); *B25G 1/063* (2013.01)

(58) Field of Classification Search
CPC ... B25F 1/04; B25F 1/003; B25B 7/18; B25G 1/063
(Continued)

(56) References Cited

U.S. PATENT DOCUMENTS 5,142,721 A * 9/1992 Sessions ..... B25B 7/22 30/123
6,003,180 A * 12/1999 Frazer ..... B25F 1/04 7/128
(Continued)

FOREIGN PATENT DOCUMENTS

CN 2278565 Y 4/1998
CN 2912916 Y 6/2007
(Continued)

OTHER PUBLICATIONS

International Search Report issued in PCT/CN2013/072733 dated Jun. 6, 2013 and English Translation, 8 pages.
(Continued)

*Primary Examiner* — Hadi Shakeri
(74) *Attorney, Agent, or Firm* — Lewis Roca Rothgerber Christie LLP

(57) ABSTRACT

The present invention discloses a pair of retractable pliers, comprising a jaw body which comprises a first and a second jaw part that are articulated together via an articulated shaft, and a handle body which comprises a first and a second internal housing. The first and the second jaw part each have a pliers head and a connection part, and the connection parts of the first and the second jaw part are slidably connected to the first and the second internal housing respectively. The pair of retractable pliers also comprises a locking structure which is arranged on the connection parts of the first and the second jaw part and which is capable of fixing the connection parts of the first and the second jaw part together. Once the locking structure is open, the pliers heads can open automatically for convenience of use.

15 Claims, 7 Drawing Sheets

(51) Int. Cl.
*B25F 1/04* (2006.01)
*B25G 1/06* (2006.01)

(58) Field of Classification Search
USPC ..... 81/407
See application file for complete search history.

(56) References Cited

U.S. PATENT DOCUMENTS

| | | | | |
|---|---|---|---|---|
| 6,131,495 | A | 10/2000 | Chen | |
| 6,185,771 | B1 * | 2/2001 | Trusty, Sr. | B25F 1/04 30/162 |
| 7,028,591 | B2 * | 4/2006 | Dallas | B25F 1/04 7/125 |
| 8,857,299 | B2 * | 10/2014 | Huttula | B25F 1/003 7/128 |
| 2001/0018779 | A1 | 9/2001 | Rivera | |
| 2004/0003472 | A1 | 1/2004 | Dallas et al. | |
| 2005/0193498 | A1 | 9/2005 | Klecker et al. | |
| 2006/0174734 | A1 | 8/2006 | Hunter | |
| 2010/0122420 | A1 | 5/2010 | Nason et al. | |
| 2015/0020651 | A1 | 1/2015 | Wang | |

FOREIGN PATENT DOCUMENTS

| | | | |
|---|---|---|---|
| CN | 2912916 | Y | 6/2007 |
| CN | 202200201 | U | 4/2012 |
| CN | 102601748 | A | 7/2012 |
| CN | 202607520 | U | 12/2012 |
| CN | 203171460 | U | 9/2013 |
| JP | 2939436 | B2 | 6/1999 |
| TW | 579924 | U | 3/2004 |

OTHER PUBLICATIONS

English Abstract of CN 2278565 Y (1 page).
English Abstract of CN 2912916 Y (1 page).
English Abstract of JP 2939436 B2 (1 page).

* cited by examiner

RETRACTABLE PLIERS

CROSS-REFERENCE TO RELATED APPLICATION(S)

This application is a National Phase Patent Application and claims priority to and benefit of International Application Number PCT/CN2013/072733, filed on Mar. 15, 2013, which claims priority to and benefit of Chinese Patent Application Number 201210070314.X, filed on Mar. 16, 2012, the entire disclosure of which are incorporated herein by reference.

FIELD OF THE INVENTION

The present invention relates to tool pliers and particularly to retractable pliers with a jaw body that can be retracted into the handle body.

DESCRIPTION OF THE PRIOR ART

It is commonly known that the pliers heads of the tool pliers are made of metal and are hard, and the pliers heads are relatively sharp and are not convenient for outdoor carrying and storing. So the retractable pliers with pliers heads which can be retracted into the handle body appear on the market. However the jaw body of the retractable pliers sold on the market at present, straightly slides in and out along the guiding slots in the handle body. That is to say, the two guiding slots respectively located on the two guiding slot of the two handle bodies are parallel. The handle bodies can't automatically open during the jaw bodies sliding in and out the handle bodies. After the jaw bodies completely come out of the handle bodies, there is no preset open-close angle between the two handle bodies, moreover the two handle bodies are completely close to each other together. This structure is very inconvenient in using and the two handle bodies may also clip the user's hands.

Therefore, a kind of more convenient retractable plier is in need.

SUMMARY OF THE INVENTION

In order to achieve the above purpose, the present invention provides a pair of retractable pliers, comprising a jaw body and a handle body, wherein the jaw body comprises a first jaw part and a second jaw part which are articulated together via an articulated shaft, the handle body comprises a first internal housing and a second internal housing, the first jaw part and the second jaw part each have a pliers head and a connection part, and the connection parts of the first jaw part and the second jaw part are slidably connected to the first internal housing and the second internal housing respectively, characterized in that the pair of retractable pliers further comprises a locking structure arranged on the connection parts of the first jaw part and the second jaw part and capable of fixing the connection parts of the first jaw part and the second jaw part together.

Wherein, the jaw body further comprises one torsion spring which is arranged at the articulated shaft between the first jaw part and the second jaw part.

Wherein, the locking structure comprises a locking block with a rear locking hook, the locking block is arranged on the connection part of the first jaw part, the locking structure further comprises a rear locking hole which is arranged at the position on the connection part of the second jaw part corresponding to the position of the rear locking hook, and the rear locking hole and the rear locking hook can be matched to lock.

Wherein, the locking block further provides a front locking hook, a front locking hole is arranged on the bottom flank of the leading end of the first internal housing which is connected to the connection part of the first jaw part, and the front locking hole and the front locking hook of the locking block can be matched to lock.

Wherein the locking block further comprises an upward extending control column, on the top of which a pushing block is arranged.

Wherein, the locking structure further includes a screw, which fixes the locking block onto the inner side of the connecting part of the first jaw part by passing through a central hole in the locking block.

Wherein, the locking structure further includes a locking block's torsion spring, which includes a ring part set on the screw and is fixed onto the inner side of the connection part of the first jaw part together with the locking block; the ring part of the locking block's torsion spring provides one elongated arm extending forward, the front end of the elongated arm provides a laterally extending arm, and the laterally extending part of the elongated arm is arranged on the front of the locking block and forms pressure on the front of the locking block.

Wherein, the rear locking hole is arranged in the extension part extending outward from the inner side of the connection part of the second jaw part.

Wherein, the locking structure further includes one caging device, which is arranged beneath the rear locking hook of the locking block, and whose poison is at the same level with that of the rear locking hole; the caging device consists of a caging pin, a pin fixing sleeve and a small spring, the small spring is installed in a installing hole arranged at the inner side of the connection part of the first jaw part, and the caging pin is fixed to the connection part of the first jaw part after being inserted into the installing holes and being sheathed with the pin fixing sleeve.

Wherein, an angle is provided between the first internal housing and the second internal housing when the pliers heads are closed.

Wherein, the connection part of the first jaw part includes one position biasing device, one end of which is movably connected to the connection part of the first jaw part, and the other end is slidably connected to the first internal housing.

In a preferred embodiment of the present invention, one elongated opening is arranged at the long-shaped bottom of the first internal housing, and the elongated opening is a guiding slot; the position biasing device comprises a connecting block, a connecting pin, a sliding block and a screw; a long-shaped hole is set on the side of the connecting block, and the connecting pin threads the long-shaped hole to be fixed with the connection part of the first jaw part; the connecting pin is capable of moving along the long axis inside the long-shaped hole; the bottom of the connecting block is located inside of the guiding slot, the sliding block is located outside of the guiding slot, and the connecting block and the sliding block are fixed together through screws and capable of sliding along the guiding slot.

Wherein, the connecting block provides two parallel flanks and a connecting wall which connects the two flanks together, and the inner edges of the flanks are circular.

Wherein, corresponding indentation is arranged at the corresponding position on the connection part of the first jaw part, the connection part of the first jaw part is embedded between the two flanks of the connecting block, and the connecting pin fixes the connecting block and the connection part of the first jaw part together by going through the symmetrical long-shaped holes on the two flanks and a through hole which is at the corresponding position on the connection part of the first jaw part.

Wherein, the position biasing device further includes one inner sliding block which is arranged in the guiding slot, flushes with the guiding slot, and is arranged between the connecting block and the sliding block.

In another preferred embodiment of the present invention, the position biasing device is one sliding pin suite which comprises an internal pin and an external pin, and a slot arranged at the flank of the connection part of the first jaw part; the internal pin is located in the external pin and its end extends into the guiding slot and is flexibly connected to the internal housing; the external pin is installed in the slot and capable of moving along the long axis of the slot to change its position to match the opening angle of the handle body.

Wherein, a fixing column with one end inserted in the guiding slot is arranged on the connection part of the first jaw part.

The handle body opens automatically during the jaw body moving in and out the handle body. After the jaw body completely comes out of the handle body, a preset open-close angle is provided between the two handle bodies. This structure is very convenient in using and the two handle bodies won't clip the user's hands.

In the following the invention will be further described on its design, detailed structures and effects with reference to the accompanying figures, to best understand the purpose, features and effects of the invention.

DETAILED DESCRIPTION OF THE PREFERRED EMBODIMENTS

Figure 1:
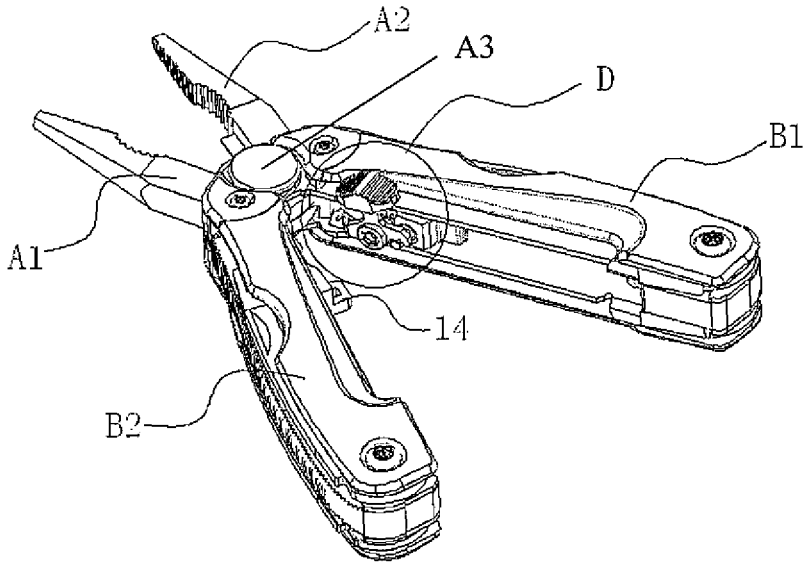
FIG. 1 is an overall structure diagram of the present invention when the jaw parts are completely out of the handle body.
Figure 2:
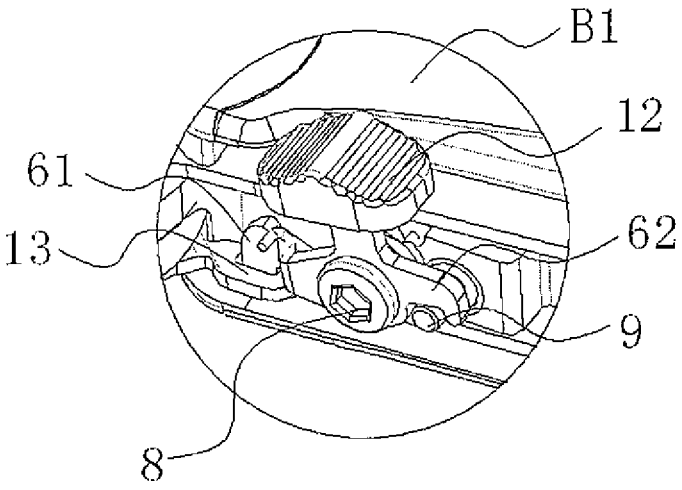
FIG. 2 is a partially enlarged structure diagram of the part D in FIG. 1.
Figure 3:
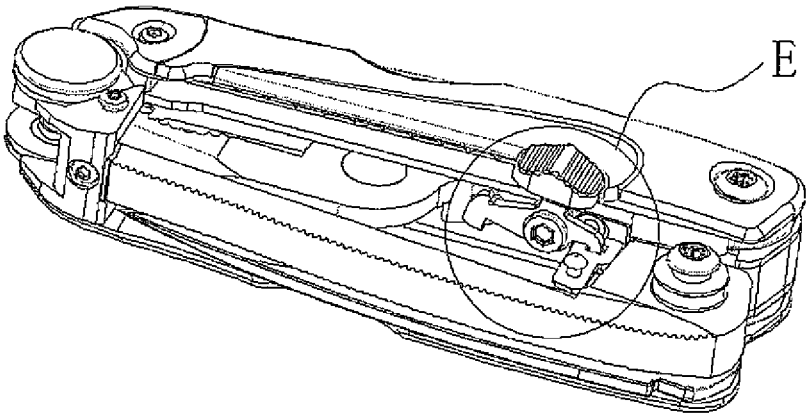
FIG. 3 is a section view of the present invention when the jaw body is completely retracted into the handle body.
Figure 4:
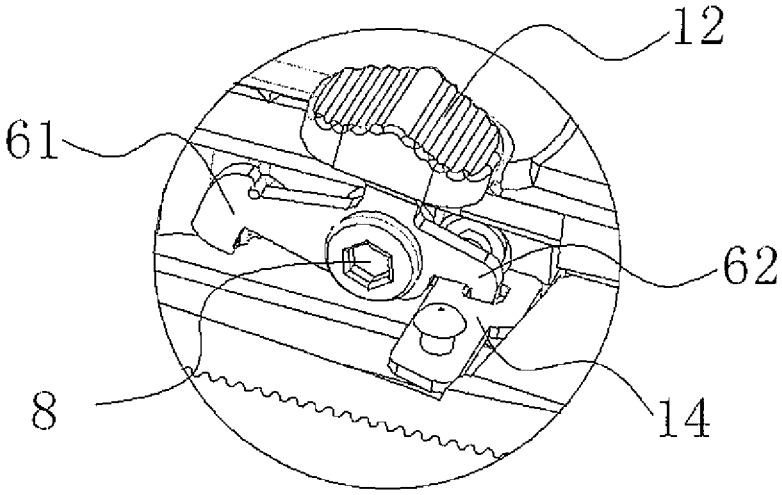
FIG. 4 is a partially enlarged structure diagram of the part E in FIG. 3.

In following the invention will be further described with reference to the accompanying figures.

As shown in FIGS. 1-5, the pair of retractable pliers includes a jaw body and a handle body in the present invention. The jaw body includes the first jaw part A1 and the second jaw part A2 which are articulated together via an articulated shaft A3. The jaw body includes one torsion spring A4 which is placed at the articulated shaft between the first jaw part A1 and the second jaw part A2. The function of the torsion spring A4 is to keep the first jaw part and the second jaw part naturally open when there is on external force, for convenient handling. The handle body includes the first handle body B1 and the second handle body B2. The first jaw part A1 and the second jaw part A2 respectively have a pliers head and a connection part 1 and 1', the connection part 1 of the first jaw part and the connection part 1' of the second jaw part can slidably connect with the first handle body B1 and the second body 132 respectively.

The first handle body B1 and the second handle body B2 include respectively the first internal housing C1 and the second internal housing C2 which are arranged inside. The connection parts 1 and 1' of the first jaw part A1 and the second jaw part A2 slidably connect to the first internal housing C1 and the second internal housing C2 respectively, that means they can slide in the first internal housing C1 and the second internal housing C2 respectively. The leading ends of the two internal housings are articulated together via a connecting screw 3, therefore the two internal housings may open and close around the connecting screw 3, and may drive the connection part of the jaw body to move when the pliers heads stretch out. Specifically, for the internal housing, by bending the long metal sheet along its long axis to form a long-shaped bottom and two parallel flanks, a long-slot-shaped internal space is formed to accommodate the connection parts 1 and 1'. The connection parts 1 and 1' may slide back and forth in the long-slot-shaped internal space of the first internal housing C1 and the second internal housing C2 respectively. The two internal housings are placed bottom out and face to face, the first jaw part A1 and the second jaw part A2 may be retracted completely into the two internal housings under the state of retraction.

The retractable pliers also include one locking structure which is arranged on the connection parts 1 and 1' of the first jaw part A1 and the second jaw part A2, and the locking structure can lock the connection parts 1 and 1' of the first jaw part A1 and the second jaw part A2. When the locking structure locks the connection parts 1 and 1' of the first jaw part A1 and the second jaw part A2, the pliers heads of the first jaw part A1 and the second jaw part A2 are in the closed state. When the locking structure releases the connection part 1 and 1' of the first jaw part A1 and the second jaw part A2, the pliers heads of the first jaw part A1 and the second jaw part A2 can open automatically due to the role of the torsion spring A4 for the convenient use.

Specifically, the locking structure includes one locking block 6 which has a rear locking hook 62 and is fixed to the inside of the connection part 1 of the first jaw part A1. A rear locking hole 14 is arranged at the corresponding position on the connection part 1' of the second jaw part A2, and the rear locking hole 14 and the rear locking hook 62 are matched to lock. Specifically, the rear locking hole 14 is arranged in the extending section which extends outward from the inside of the connection parts 1' of the second jaw part A2. The locking block 6 also has a front locking hook 61, and a front locking hole 13 is arranged at the corresponding position of the front locking hook 61 and on the bottom flank of the leading end of the internal housing, which is connected to the connection part 1 of the first internal housing with a locking stock installed. The front locking hole 13 and the front locking hook 61 of the locking block are matched to lock. On the internal housing C1, the width of the flank with the front locking hole 13 arranged is larger than the width of the other flank, and the wider part of the flank contacts with the front locking hook 61 of the locking structure. The main function of width part of the flank is that when the pliers heads are retracted, the locking block moves back, and after the front locking hook 61 detaching from the front locking hole 13, it moves back along the wider part of the flank to lift the front locking hook 61 and press the rear locking hook 62, thus the rear locking hook 62 can hook up the rear locking hole 14 and lock the jaw body. When the jaw body is pushed out completely, the locking block moves forward to the front end of the internal housing, and the front locking hook 61 hooks up the front locking hole 13.

In particular, the locking structure also includes a screw 8 which goes through a hole in the middle of the locking block 6 to fix the locking block 6 to the inner side of the connection part 1. The locking structure further includes a locking block's torsion spring, and the locking block's torsion spring 7 includes a ring part set on the screw 8 and fixed onto the inner side of the connection part 1 together with the locking block. The ring part of the locking block's torsion spring 7 has one elongated arm extending forward, and the front end of the elongated arm has a laterally extending arm. The laterally extending part of the elongated arm is arranged on the front of the locking block 6 and can form pressure on the locking block. The locking block 6 further includes an upward extending control column 63 between the front locking hook 61 and the rear locking hook 62. Specifically, the locking hook 61, the rear locking hook 62 and the control column 63 are integrally formed. On the top of the control column 63, a pushing block 12 is connected. The arrangement of the pushing block 12 is for the convenient operating on the locking block 6. By applying a force to it to overcome the elastic force of the locking block's torsion spring 7 to lift the front locking hook of the locking block 6, the front locking hook will be off the front locking hole 13 and move back.

Figure 5:
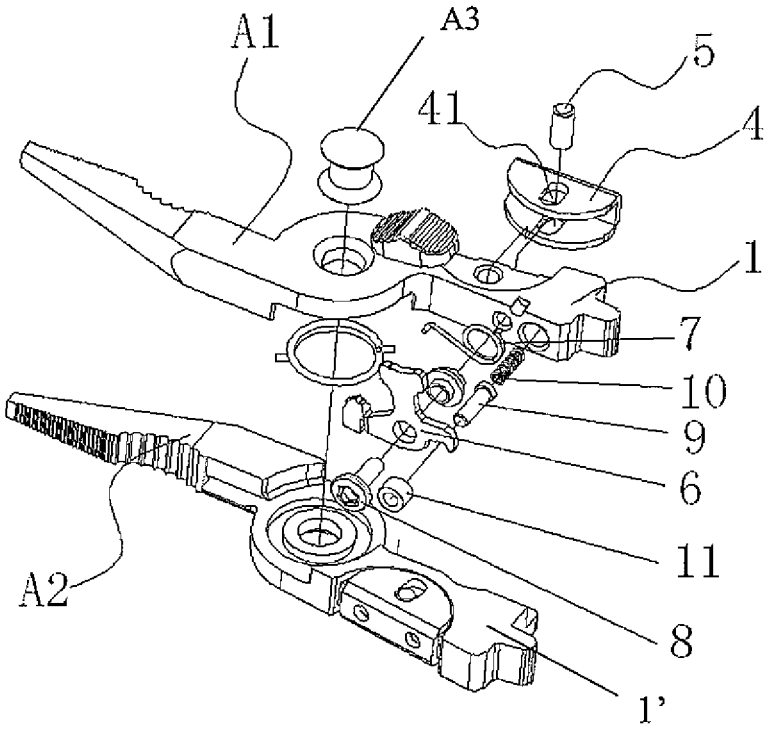
FIG. 5 is an exploded view of the jaw body in the first embodiment of the present invention.
Figure 6:
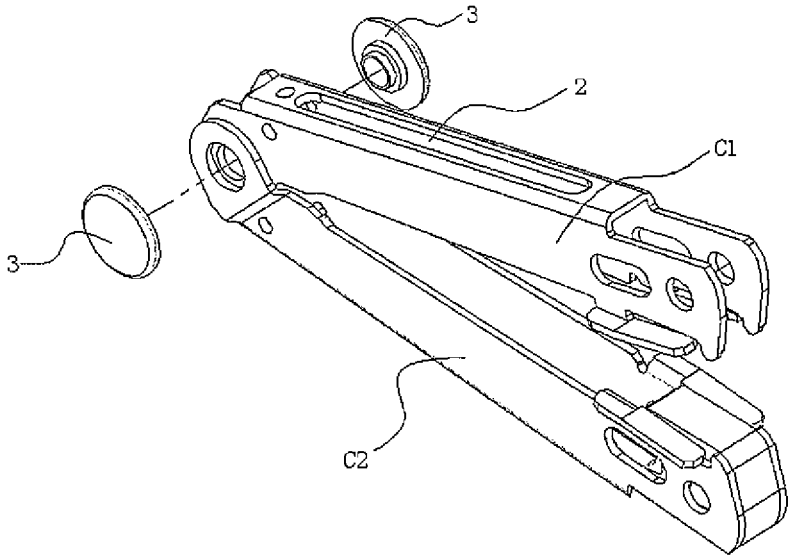
FIG. 6 is a structure diagram of the combination of the first internal housing and the second internal housing in the first embodiment of the present invention.

As shown in FIG. 5, as a further improvement, the locking structure further includes one caging device which is arranged beneath the rear locking hook 62 of the locking block 6. The position of the caging device and the position of the rear locking hole 14 are at the same level. The caging device consists of a caging pin 9, a fixing pin sleeve 11 and a small spring 10. The small spring 10 is installed in the installing hole which is arranged on the inner side of the connection part 1, after inserting into the installing hole and sheathing it with the fixing pin sleeve 11, the caging pin 9 fixed to the connection part 1. As to the caging device, when the first jaw part A1 or the second jaw part A2 are retracted, the rear locking hole 14 will resist the caging pin 9 to make it shrink, so that the rear locking hook 62 of the locking block 6 may turn downward and hook up the rear locking hole 14 and lock the jaw body to keep two jaw parts closed.

In general, the working process of the locking structure of the invention is described as follows. When the lock is open, that is when the locking block 6 and the rear locking hole 14 are apart, the first jaw part A1 and the second jaw part A2 are in a state with no external force and the pliers heads reach out completely. Due to the role of the torsion spring, the pliers heads of the first jaw part A1 and the second jaw part A2 are in a naturally apart state. At this time, the front locking hook 61 of the locking block 6 hooks up the front locking hole 13 of the internal housing C1, the caging device beneath the rear locking hook 62 is in the reached out state to fix the rear locking hook, the front locking hook 61 can't get off the front locking hole 13, therefore the locking block and the internal housing fix each other. Since the locking block 6 is fixed on the first jaw part A1, the first jaw part and the internal housing fix each other, i.e. the pliers heads keep the reaching out state and are unable to move.

When stop using the retractable pliers, clamp the first handle body B1 and the second handle body B2, that is, clamp the first internal housing C1 and the second internal housing C2. The inner side of the rear locking hole 14 which is located on the connection part 1' will compress the caging device, and the rear locking hook 62 is above the rear locking hole 14. Push the pushing block 12 backward at the same time, the pushing force overcomes the pressure of the torsion spring of locking block to the front locking hook, and the front locking hook will be pulled out from the front locking hole, and move back. At this time the rear locking hook 62 hooks up the rear locking hole 14, the connection part 1 and 1' of the first jaw part A1 and the second jaw part A2 locked together, the pliers heads of the first jaw part (A1) and the second jaw part (A2) in the closed state. Keep on pushing back the pushing block 12, until the pliers heads are completely retracted into the inside of the first internal housing C1 and the second internal housing C2.

In use, push forward the pushing block 12, the front locking hook moving along the inner side of the flank. When the front locking hook arrives at the front locking hole 13, it will hook up the front locking hole 13 immediately under the action of the locking block's torsion spring. In the meantime, the rear locking hook moves upward and get off the rear locking hole, and the rear locking hole will be pushed off the locking block 6 under the action of the spring of the caging device. The caging device is hooked up at the rear locking hook to cage the locking block and the locking block can't move. At the time, the pliers heads are in the fully reaching out state.

Figure 7:
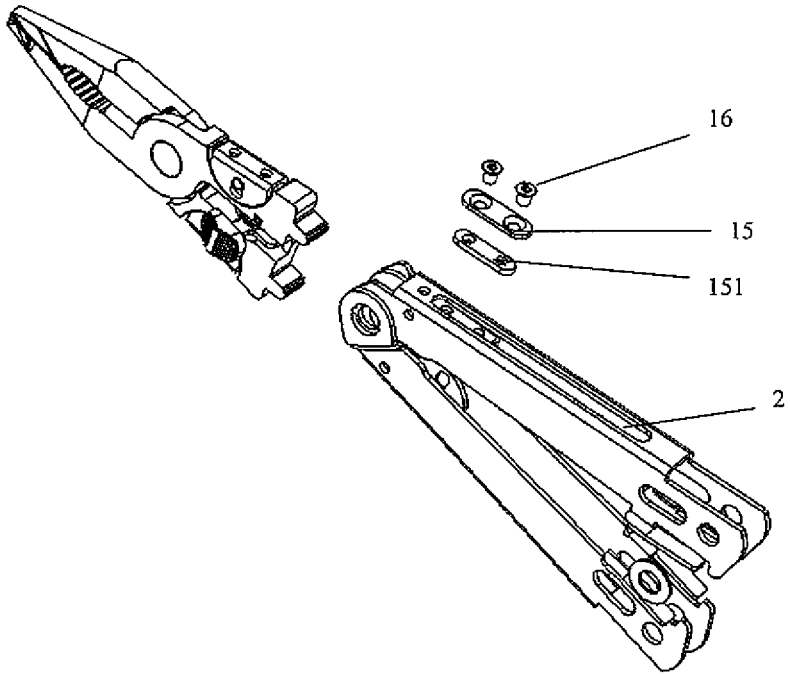
FIG. 7 is an assembly drawing of the jaw body and the internal housing in the first embodiment of the present invention.
Figure 8:
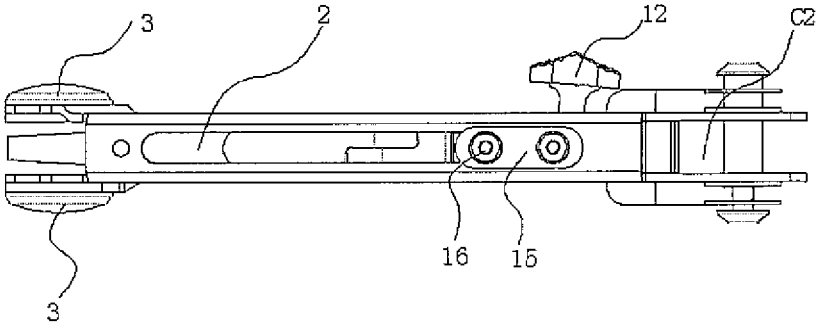
FIG. 8 is a side view of the internal housing with a jaw body installed in the first embodiment of the present invention.
Figure 9:
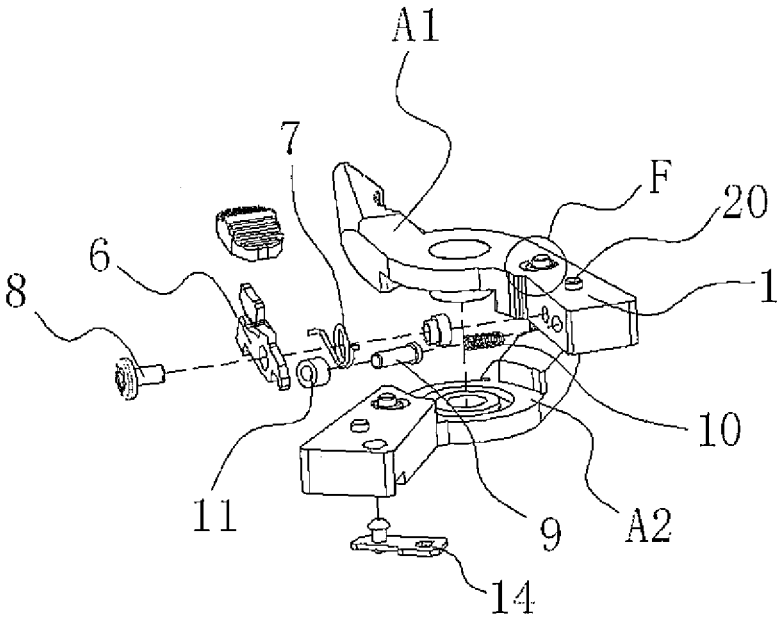
FIG. 9 is a structure diagram of the jaw body in another embodiment of the present invention.

As shown in FIG. 7, the two internal housings are not parallely arranged and there is an angle between them when the pliers heads are in the closed state. Namely, the two internal housings gradually extend outward from the connection position of the connecting pin 3 at the front. This is convenient for using but difficult for designing. The structures of the connection parts of the first jaw part and the second jaw part, which are slidably connected to the internal housings, can be symmetrical, and the first internal housing and the second internal housing can be symmetrical as well. Therefore only the structure of the connection part 1 of the first jaw part and the first internal housing are explained here.

The connection part 1 of the first jaw part includes one position biasing device, one end of which connects to the connection part 1, and the other end connects to the internal housing 1. Wherein, the position biasing device could slide lengthwise along the internal housing. During sliding, as the internal housing gradually extends outward toward the sides, the distance between the connection part 1 of the first jaw part and the internal housing gradually increases, the position biasing device could change its position to adapt to this change during its sliding along the internal housing. The position biasing device could deviate from the connection part 1 of the first jaw part toward the internal housing, and it could also deviate from the internal housing toward the connection part 1 of the first jaw part.

Specifically, the long-shaped bottom of the first internal housing has an elongated opening which is guiding slot 2. As shown in FIG. 5 and FIG. 7, the position biasing device comprises a connecting block 4, a connecting pin 5, a sliding block 15 and a screw 16. The connecting pin 5 threads the long-shaped hole 41 which is arranged on the side wall of the connecting block 4, to be fixed to the connection part 1. Moreover, the connecting pin can move along the long axis inside the long-shaped hole 41, i.e., the connecting block 4 can move relatively along the connecting pin 5. The connecting block 4 is inside of the guiding slot, the sliding block 15 is outside of the guiding slot, and the two are fixed together through the screws 16 and they can slide along the guiding slot. Wherein, there exists an angle between the long axis of the long-shaped hole 41 and the guiding slot 2. During the movement of the jaw body, the connecting block 4 will move along the long axis of the long-shaped hole 41, in the meantime the connecting block 4 rotates about the axis of the connecting pin 5 to adjust its angle to match the open angle of the handle body. So that the sliding block 15 and the guiding slot 2 could always be kept parallel to each other, and a steady and smooth movement of the jaw body is maintained. In other words, when the connection parts of the jaw body slide forward along the internal housing and the pliers heads stretch out, the connecting block 4 moves inward along the long axis of the long-shaped hole 41 and is gradually closing to the connection parts of the jaw body. When the connection parts of the jaw body slide backward along the internal housing and the pliers heads are retracted, the connecting block 4 moves outward along the long axis of the long-shaped hole 41 and is gradually away from the connection parts of the jaw body.

Specifically, the connecting block 4 has two parallel flanks and a connecting wall which connects two flanks together, the inner edges of flanks are circular, and there is a corresponding indentation at the corresponding position of the connection part 1 of the first jaw part, the connection part 1 of the first jaw part is embedded between the two flanks of the connecting block 4, to ensure that the external parts of connection part are neat and smooth. The connecting pin 5 fixes the connecting block 4 and the connection part 1 of the first jaw part together by going through the long-shaped hole 41 with two flanks symmetrically arranged and a through hole on the corresponding position of the connection part 1 of the first jaw part. In this design, the biasing motion of the position biasing device is more stable and reliable. The position biasing device also includes one inner sliding block 151 which is arranged in the guiding slot and parallel to the guiding slot, and the inner sliding block 151 is arranged between the connecting block and sliding block 15 to make the sliding between the connecting block and the guiding slot more stable and reliable.

Figure 10:
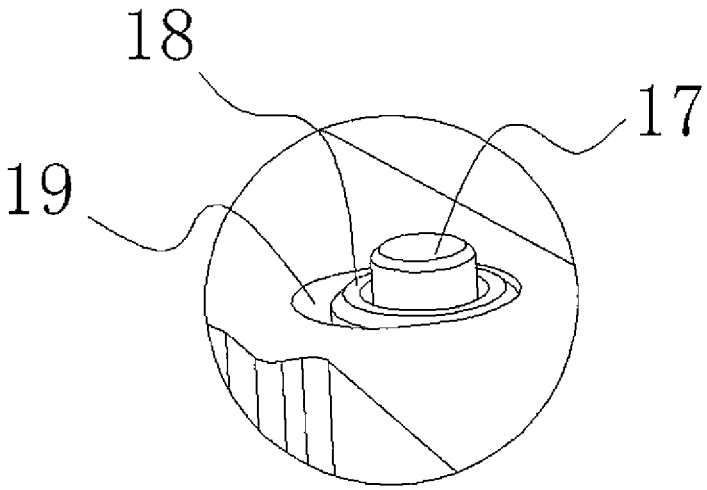
FIG. 10 is a partially enlarged structure diagram of the part F in FIG. 9.
Figure 11:
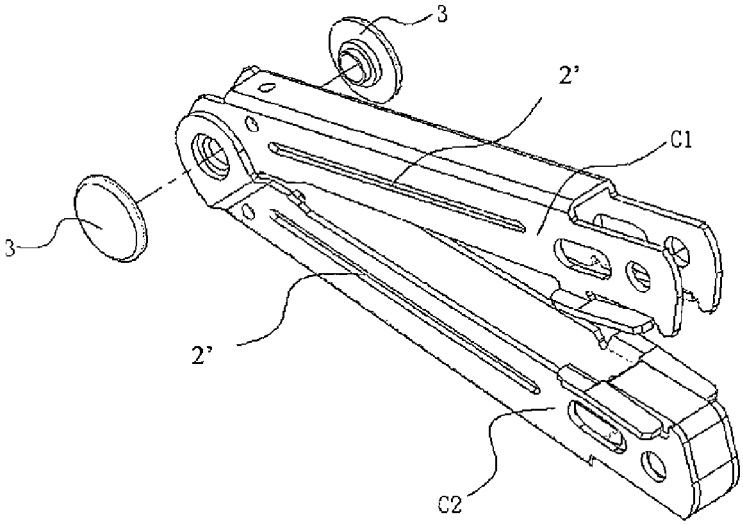
FIG. 11 is a structure diagram of the combination of the first internal housing and the second internal housing in another embodiment of the present invention.
Figure 12:
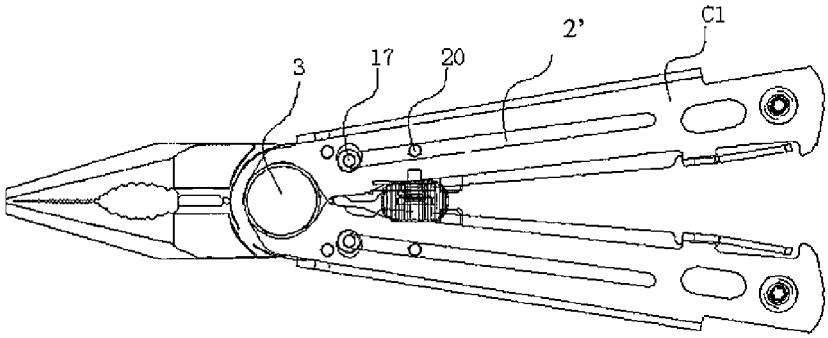
FIG. 12 is a front view of the internal housing installed with jaw body installed in another embodiment of the present invention.
Figure 13:
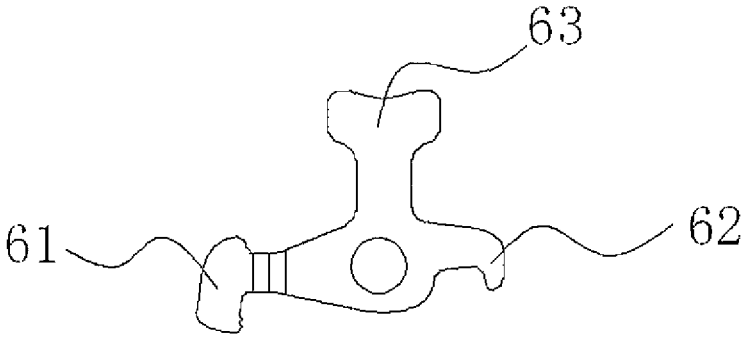
FIG. 13 is a structure diagram of the locking block of the present invention.
Figure 14:
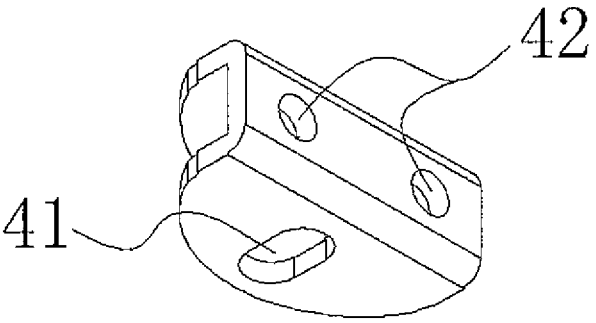
FIG. 14 is a structure diagram of the connecting block of the position biasing device in another embodiment of the present invention.

In another embodiment, as shown in FIGS. 9-12, the position biasing device is one sliding pin suite which comprises an internal pin 17 and an external pin 18, and a slot 19 arranged on the connection part 1 of the first jaw part. As shown in FIG. 10 and FIG. 11, in order to coordinate the position arrangement of the sliding pin suite, the guiding slot 2' is arranged on the flank of the internal housing. The internal pin 17 is located in the external pin 18 and its end extends into the guiding slot 2' and is flexibly connected with the internal housing, the external pin 18 is installed in the slot 19, wherein there is an angle between the long axis of the slot 19 and the long axis of the guiding slot 2. Moreover, a fixing column 20 with an end inserted into the guiding slot 2 was set on the connection part 1 of the first jaw part to match the sliding pin suite. During the pliers heads movement process, the external pin 18 of the sliding pin suite will move along the long axis of the slot 19 to change its position to match the open angle of the handle body, while the internal pin 17 always moves along the guiding slot 2 to maintain a stable and smooth movement of the jaw body, while the action of the fixing column 20 is auxiliary positioning.

The handle body of the present invention includes an external housing. There exists space between the internal and external housings and an axis is arranged at the end of the external housing. Cutting tools and other common tools are placed coaxially, and can be folded into the inner space between the internal and external housings when they are not in use.

When the pliers heads are completely retracted in the handle body and need to be opened, push forward the pushing block 12. The connection part 1 and 1' slide forward along the first internal housing and the second internal housing under the action of the position biasing device, until the front locking hook hooks up the front locking hole and the rear locking hole is off the rear locking hook. The pliers heads can open automatically under the action of the torsion spring for convenience.

After use, the pliers heads need to be retracted into the handle body. Clamp both of the first handle body and the second handle body and push backward the pushing block to overcome the force of the locking block's torsion spring. The front locking hook will be off the front locking hole and the rear locking hook will hook up the rear locking hole. Keep on pushing backward the pushing block, the pliers heads will be retracted into the handle body completely under the action of the position biasing device.

The above examples described preferred concrete embodiment of the present invention in detail. It is to be appreciated that the common technician in the art of personnel can make many modifications and variation according to the conception of the present invention without needing for creative labor. Therefore, the technician in the art of personnel can obtain technical solutions via logical, reasoning or limited experiments on the basis of the prior art according to the conception of the present invention, and all these solutions should be defined by claims within the scope of protection.

The invention claimed is:

1. A pair of retractable pliers, comprising a jaw body and a handle body, wherein the jaw body comprises a first jaw part and a second jaw part which are articulated together via an articulated shaft, the handle body comprises a first internal housing and a second internal housing, the first jaw part and the second jaw part each have a pliers head and a connection part, and the connection parts of the first jaw part and the second jaw part are slidably connected to the first internal housing and the second internal housing respectively, characterized in that the pair of retractable pliers further comprises a locking structure arranged on the connection parts of the first jaw part and the second jaw part and capable of fixing the connection parts of the first jaw part and the second jaw part together; wherein the jaw body further comprises one torsion spring which is arranged at the articulated shaft between the first jaw part and the second jaw part; wherein the locking structure comprises a locking block with a rear locking hook, the locking block is arranged on the connection part of the first jaw part, the locking structure further comprises a rear locking hole which is arranged at the position on the connection part of the second jaw part corresponding to the position of the rear locking hook, and the rear locking hole and the rear locking hook can be matched to lock.

2. The pair of retractable pliers according to claim 1, wherein the locking block further provides a front locking hook, a front locking hole is arranged on the bottom flank of the leading end of the first internal housing which is connected to the connection part of the first jaw part, and the front locking hole and the front locking hook of the locking block can be matched to lock.

3. The pair of retractable pliers according to claim 1, wherein the locking block further comprises an upward extending control column, on the top of which a pushing block is arranged.

4. The pair of retractable pliers according to claim 3, wherein the locking structure further comprises a screw, which fixes the locking block onto the inner side of the connecting part of the first jaw part by passing through a central hole in the locking block.

5. The pair of retractable pliers according to claim 4, wherein the locking structure further comprises a locking block's torsion spring, which comprises a ring part set on the screw and is fixed onto the inner side of the connection part of the first jaw part together with the locking block; wherein the ring part of the locking block's torsion spring provides one elongated arm extending forward, the front end of the elongated arm provides a laterally extending arm, and the laterally extending part of the elongated arm is arranged on the front of the locking block and forms pressure on the front of the locking block.

6. The pair of retractable pliers according to claim 5, wherein the rear locking hole is arranged in the extension part extending outward from the inner side of the connection part of the second jaw part.

7. The pair of retractable pliers according to claim 6, wherein the locking structure further comprises one caging device, which is arranged beneath the rear locking hook of the locking block and whose position is at the same level with that of the rear locking hole; wherein the caging device consists of a caging pin, a pin fixing sleeve and a small spring, the small spring is installed in a installing hole arranged at the inner side of the connection part of the first jaw part, and the caging pin is fixed to the connection part of the first jaw part after being inserted into the installing holes and being sheathed with the pin fixing sleeve.

8. The pair of retractable pliers according to claim 7, wherein an angle is provided between the first internal housing and the second internal housing when the pliers heads are closed.

9. The pair of retractable pliers according to claim 8, wherein the connection part of the first jaw part comprises one position biasing device, one end of which is movably connected to the connection part of the first jaw part, and the other end is slidably connected to the first internal housing.

10. The pair of retractable pliers according to claim 9, wherein one elongated opening is arranged at a long-shaped bottom of the first internal housing, and the elongated opening is a guiding slot; the position biasing device comprising a connecting block, a connecting pin, a sliding block and at least one screw; a long-shaped hole being set on the side of the connecting block, and the connecting pin threading the long-shaped hole to be fixed with the connection part of the first jaw part; the connecting pin being capable of moving along the long axis inside the long-shaped hole; the bottom of the connecting block being located inside of the guiding slot, the sliding block being located outside of the guiding slot, and the connecting block and the sliding block being fixed together through said at least one screw and capable of sliding along the guiding slot.

11. The pair of retractable pliers according to claim 10, wherein the connecting block provides two parallel flanks and a connecting wall which connects the two flanks together, and the inner edges of the flanks are semi-circular.

12. The pair of retractable pliers according to claim 10, wherein the position biasing device is one sliding pin suite which comprises an internal pin and an external pin, and a slot arranged at a flank of the connection part of the first jaw part; wherein the internal pin is located in the external pin and its end extends into the guiding slot and is flexibly connected to the internal housing; the external pin being installed in the slot and capable of moving along the long axis of the slot to change its position to match the opening angle of the handle body.

13. The pair of retractable pliers according to claim 12, wherein a fixing column with one end inserted in the guiding slot is arranged on the connection part of the first jaw part.

14. The pair of retractable pliers of claim 11, wherein corresponding indentation is arranged at the corresponding position on the connection part of the first jaw part, the connection part of the first jaw part is embedded between the two flanks of the connecting block, and the connecting pin fixes the connecting block and the connection part of the first jaw part together by going through the symmetrical long-shaped holes on the two flanks and a through hole which is at the corresponding position on the connection part of the first jaw part.

15. The pair of retractable pliers according to claim 14, wherein the position biasing device further comprises one inner sliding block, which is arranged in the guiding slot, flushes with the guiding slot, and is arranged between the connecting block and the sliding block.

* * * * *